US009538799B2

(12) United States Patent
Dodd

(10) Patent No.: US 9,538,799 B2
(45) Date of Patent: Jan. 10, 2017

(54) WATERTIGHT CAP

(76) Inventor: Karetha Dodd, Chelsea, MA (US)

( * ) Notice: Subject to any disclaimer, the term of this patent is extended or adjusted under 35 U.S.C. 154(b) by 299 days.

(21) Appl. No.: 12/686,731

(22) Filed: Jan. 13, 2010

(65) Prior Publication Data

US 2010/0192273 A1 Aug. 5, 2010

Related U.S. Application Data

(60) Provisional application No. 61/148,694, filed on Jan. 30, 2009.

(51) Int. Cl.
*A42B 1/12* (2006.01)
*A63B 33/00* (2006.01)

(52) U.S. Cl.
CPC *A42B 1/12* (2013.01); *A63B 33/00* (2013.01)

(58) Field of Classification Search
CPC ..... A42B 1/12
USPC ..... 2/68, 195.1, 172, 181, 181.2, 195.3,2/200.1, 200.2, 423, 171.4, 171.5, 171.7, 183,2/195.4
See application file for complete search history.

(56) References Cited

U.S. PATENT DOCUMENTS

| | | | | |
|---|---|---|---|---|
| 1,156,238 | A * | 10/1915 | Litchfield | 2/68 |
| 2,063,232 | A * | 12/1936 | Davies | 2/68 |
| 2,072,483 | A | 3/1937 | Naundorf | |
| 2,520,049 | A | 6/1948 | Moore | |
| 2,647,259 | A | 8/1953 | Hutton | |
| 2,704,846 | A * | 3/1955 | Weikert | 2/68 |
| 3,206,761 | A * | 9/1965 | Melnikoff | 2/68 |
| 3,381,305 | A | 5/1968 | Buzzelli | |
| 3,488,774 | A * | 1/1970 | Abbott | 2/68 |
| 3,714,670 | A * | 2/1973 | Pollack et al. | 2/183 |
| 3,996,621 | A | 12/1976 | Martienssen | |
| 4,400,830 | A * | 8/1983 | Gaitan | 2/68 |
| 4,612,672 | A * | 9/1986 | Schrack | 2/68 |
| 5,046,193 | A * | 9/1991 | Foresman et al. | 2/68 |
| 5,349,702 | A * | 9/1994 | Runckel | 2/68 |
| 6,052,825 | A * | 4/2000 | Dodd | 2/68 |
| 6,966,068 | B2 * | 11/2005 | Johnson et al. | 2/68 |
| 7,472,428 | B2 * | 1/2009 | Van Atta et al. | 2/68 |

FOREIGN PATENT DOCUMENTS

| | | |
|---|---|---|
| DE | 1914833 | 4/1965 |
| EP | 686356 | 12/1995 |
| EP | 0686356 A1 | 12/1995 |
| FR | 853960 | 11/1938 |
| JP | 60-109645 | 7/1985 |
| JP | H08505558 | 6/1996 |

(Continued)

OTHER PUBLICATIONS

Lee, Won Jae, Authorized Officer, ISA/KR, International Search Report and Written Opinion dated Sep. 16, 2010, 10 pp., regarding PCT/US2010/022550 filed Jan. 29, 2010.

(Continued)

*Primary Examiner* — Sally Haden
(74) *Attorney, Agent, or Firm* — Konrad Sherinian; Depeng Bi; The Law Offices of Konrad Sherinian, LLC

(57) ABSTRACT

A swim cap includes a shell forming a concave region terminating at a circumferential rim, and a resilient margin secured to the shell along the circumferential rim. The margin and circumferential rim form a visible boundary, while the shell and resilient margin each are formed from substantially waterproof material. The swim cap also can include at least one fastener configured to tighten the margin.

8 Claims, 5 Drawing Sheets

(56) References Cited

FOREIGN PATENT DOCUMENTS

| | | |
|---|---|---|
| JP | 2001-087420 | 4/2001 |
| KR | 20-0184363 | 3/2000 |
| KR | 200184363 | 6/2000 |
| WO | WO 9510334 | 4/1995 |

OTHER PUBLICATIONS

Jennifer D'Souza, European Patent Office, The Hague, Supplementary European Search Report, Application EP10736442, Oct. 1, 2013, 4 pages.
Web page screen shot of Australia Patent Office showing the Allowance of the Australia counterpart of the instant patent application.
Australian Patent office action of the counterpart of the instant patent application.
PCT search report of PCT application.
Office Action of the European counterpart of the instant disclosure.
Office Action of the Canadian counterpart of the instant disclosure.
Office Action of the Japan counterpart of the instant disclosure.
Bibliographic data: JPH08505558, Espacenet.
Notice of Acceptance of Australian patent application of the present disclosure, Australian Government, IP Australia, Jul. 5, 2016.
European Patent Office's Notice of Allowance of the Europe counterpart of the instant patent application.

* cited by examiner

WATERTIGHT CAP

The present application claims priority from U.S. Provisional Application No. 61/148,694, filed Jan. 30, 2009, the full disclosure of which is hereby incorporated by reference herein.

TECHNICAL FIELD

The present invention relates to headgear, and more particularly to caps for wearing in wet environments to protect a user's hair and, when swimming, to keep the wearer's hair from obstructing his/her view and to keep the wearer's hair out of drainage systems.

BACKGROUND ART

Many people wear a cap when swimming or bathing. Prior art caps do not provide a comfortable and convenient solution for protecting a user's hair from getting wet when submerged in water, or when engaged in vigorous activity in water, such as swimming. For example, some caps are overly bulky, uncomfortably tight, or require straps under the user's chin, etc. Others are light and comfortable. However, none of these caps adequately prevent a user's hair from getting wet. For example, they do not have an effective mechanism for preventing the volume of hair placed into the cap from affecting the tightness of the margin, which tightness minimizes water entry. In addition, they do not have a mechanism that effectively minimizes the gaps between the cap and the wearer's head caused by the protrusion of the ears and natural curvatures of the neck. In addition, none of these caps have a mechanism for keeping the tension of the cap shell from causing the cap to retract (i.e., ride up) when the wearer is engaged in movement such as swimming.

SUMMARY OF THE INVENTION

In accordance with one embodiment, a swim cap has a shell forming a concave region terminating at a circumferential rim, and a resilient margin secured to the shell along the circumferential rim. The margin and circumferential rim form a visible boundary. The shell and resilient margin each are formed from substantially waterproof material. In a related embodiment, the substantially waterproof material is neoprene. The neoprene may have a thickness between about 0.5 mm and 3 mm. The margin may have a width substantially between about 1 inch and about 2 inches.

In a related embodiment, the substantially waterproof material of the shell and the substantially waterproof material of the margin are the same material.

In another related embodiment, the substantially waterproof material of the shell and the substantially waterproof material of the margin are different materials.

In another related embodiment, the swim cap also includes at least one fastener configured to tighten the margin at the ears and along the neckline where gaps occur due to ear protrusion and natural curvatures in the neck during movement.

Another embodiment of the invention provides a swim cap formed from a shell having a concave region terminating at a circumferential rim. The swim cap also has a resilient margin secured to the shell along the circumferential rim to form a visible boundary. The shell and margin are formed from substantially waterproof material. The method also positions the swim cap on a user's head, (e.g., positioning the user's head into the concave region) to substantially completely cover the user's hair and cause the resilient margin to seal against the user's head to provide a substantially watertight seal.

In a related embodiment, the method also provides at least one fastener configured to tighten the margin at the ears and along the neckline.

In another related embodiment, the user's head is submerged in water.

In another related embodiment, the user is swimming.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

In illustrative embodiments of the invention, a swim cap substantially keeps a user's hair dry while swimming. To those ends, the swim cap may have a two-piece construction that adequately secures around the head to provide a watertight seal. Details of various embodiments are discussed below.

Figure 1:
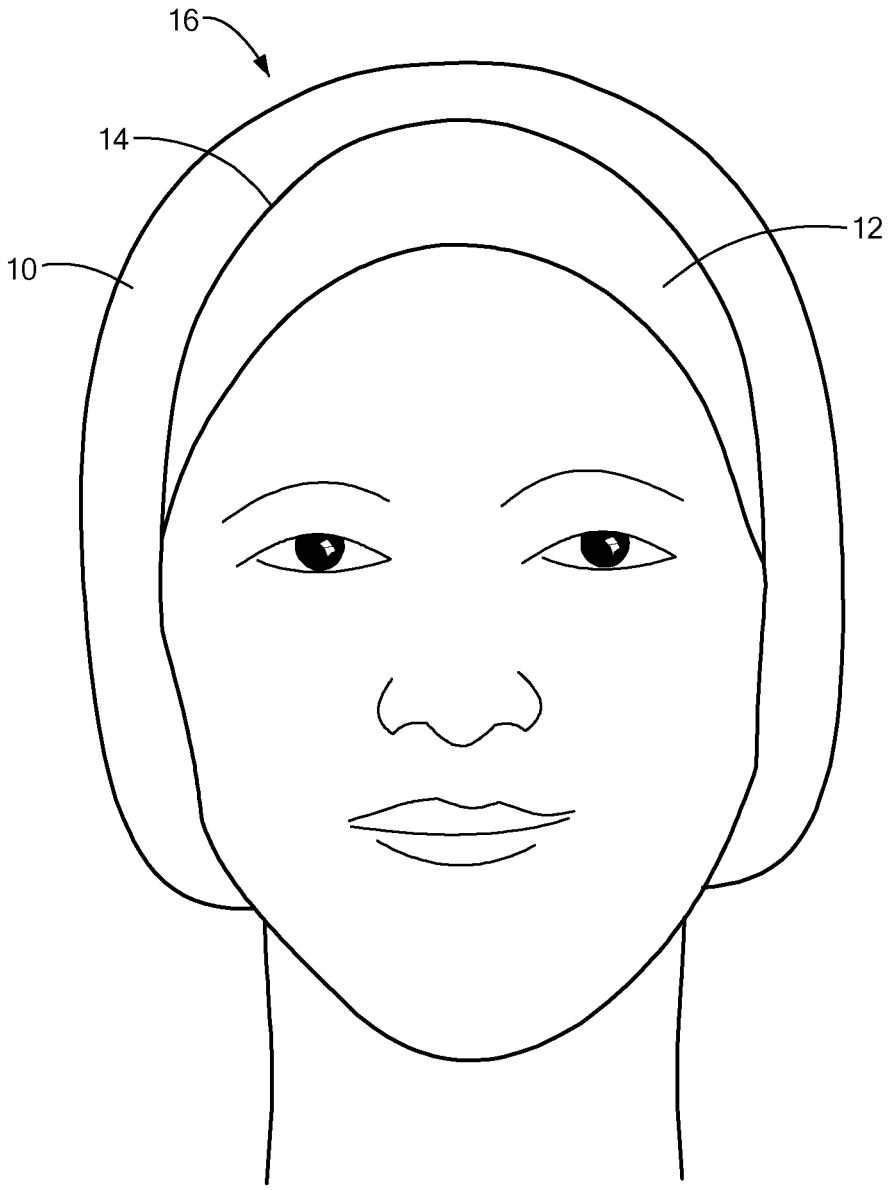
FIG. 1 schematically shows a front view of a watertight cap in accordance with illustrative embodiments of the invention.
Figure 2:
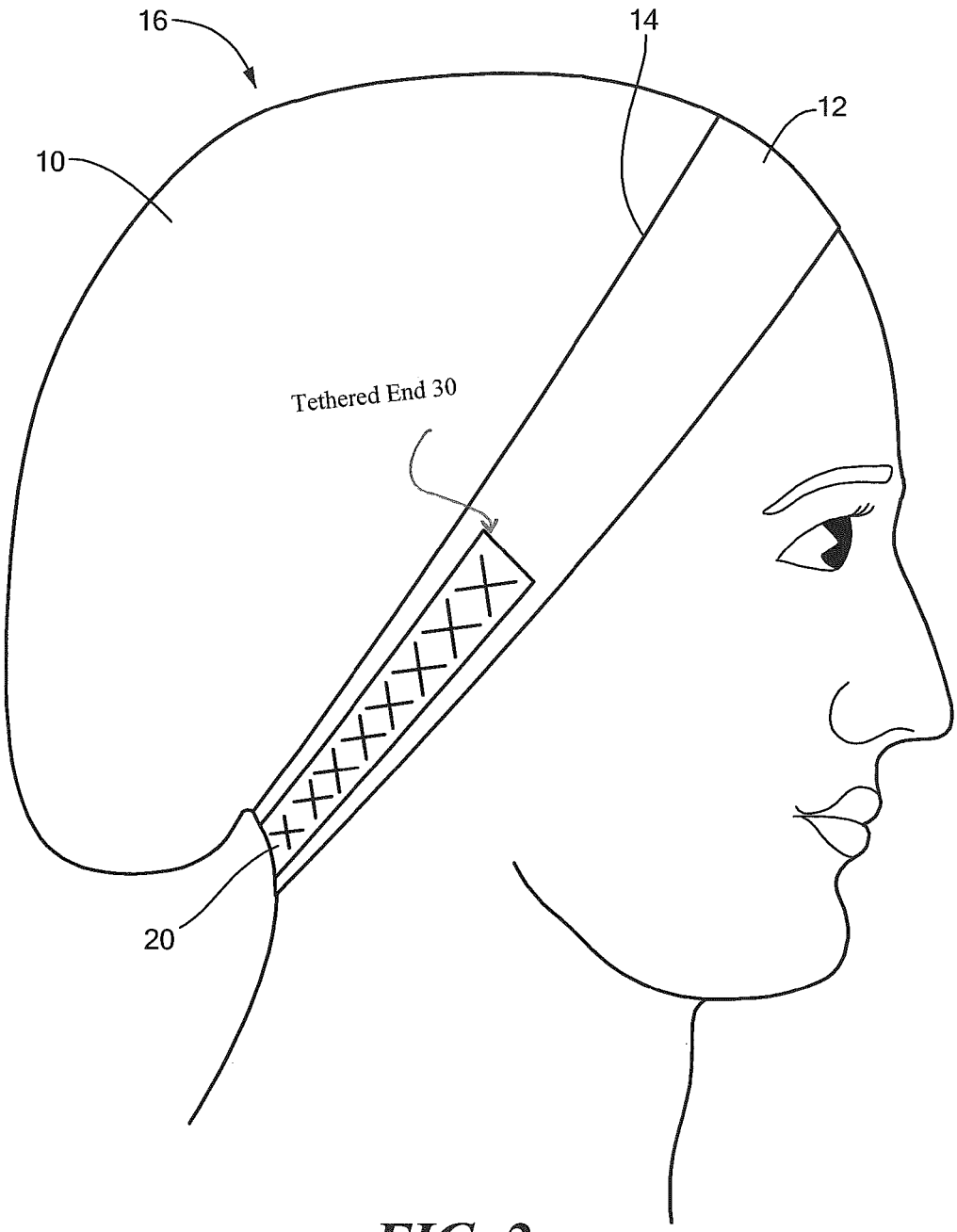
FIG. 2 schematically shows a side view of the watertight cap of FIG. 1.
Figure 3A:
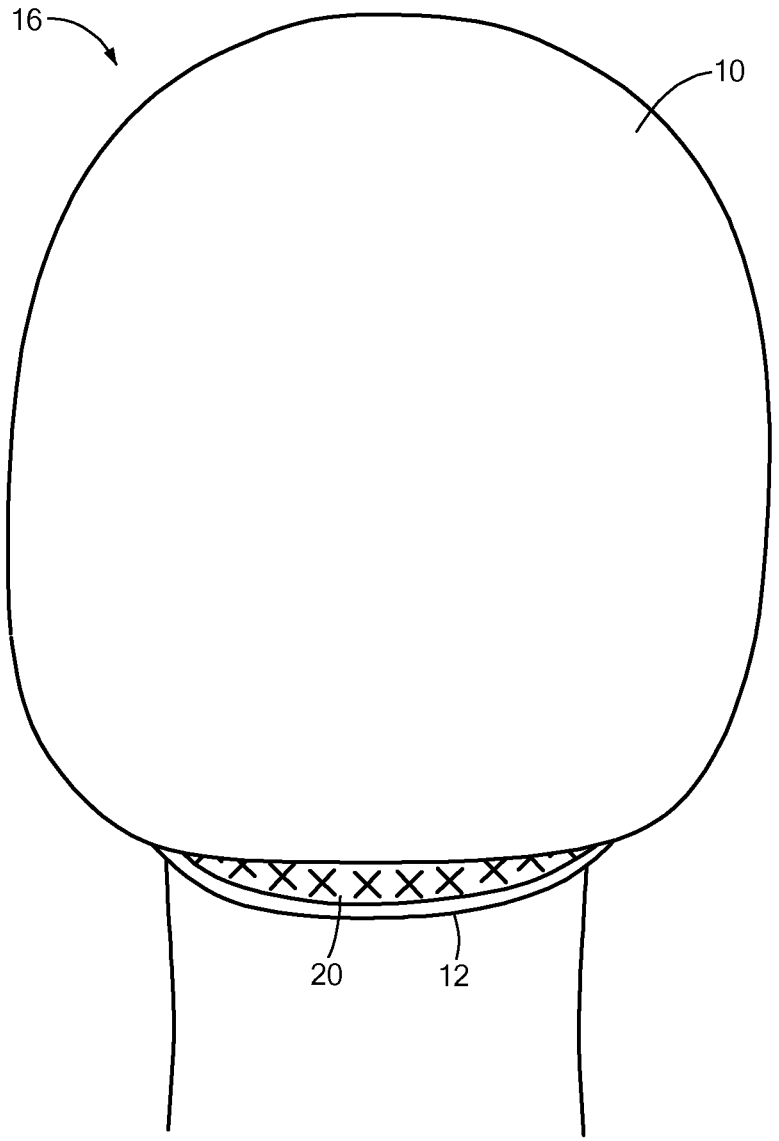
FIG. 3A-C schematically shows a rear views of the various embodiments of the watertight cap of FIG.1.
Figure 3B:
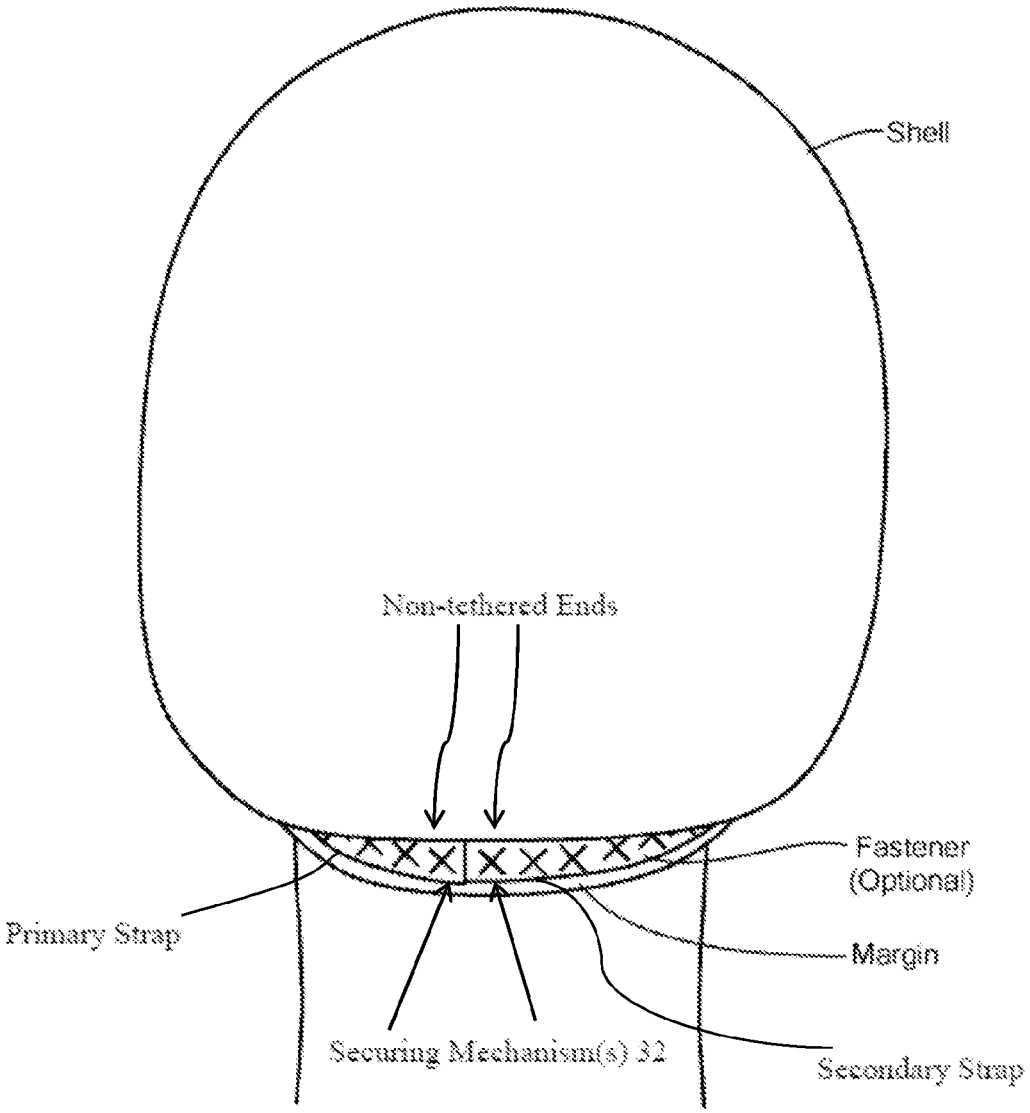

FIG. 1 schematically shows a front view of a watertight cap 16 in accordance with an embodiment of the invention. FIG. 2 is a side view of the watertight cap 16 of FIG. 1, and FIGS. 3A-B are rear views of the watertight cap 16 of FIG. 1. The watertight cap 16 includes a shell 10 forming a concave region terminating at a circumferential rim 14, and a resilient margin 12 secured to shell 10 along the circumferential rim 14. As shown, the circumferential rim 14 terminates at a seam where the shell 10 and the margin 12 are sewn or glued or molded together.

The shell 10 and the margin 12 are both formed from a substantially waterproof material, such as neoprene. In other embodiments, however, the shell 10 and the margin 12 may be formed from different materials. For example, the shell 10 may be formed from neoprene, while the margin 12 may be formed from latex.

Figure 3C:
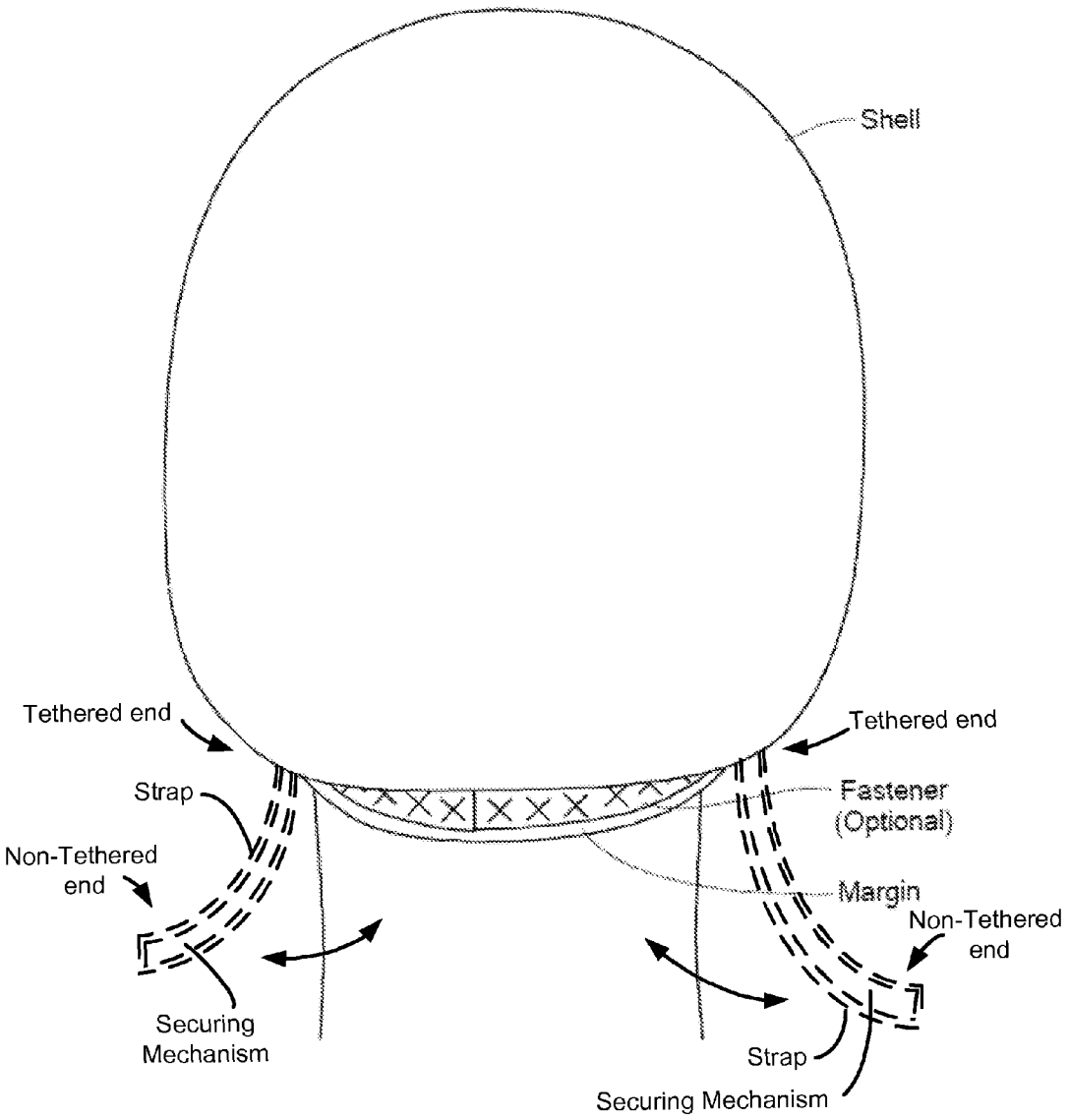

The swim cap 16 has additional means for tightening the cap 16 around a user's head. By doing this, the swim cap 16 is less likely to leak and thus, it provides a water tight seal. To that end, as shown in FIGS. 2 and 3, the watertight cap 16 also may include one or more fasteners 20 secured to the margin. In illustrative embodiments, the fasteners are straps with a securing mechanism (shown schematically as boxes with "X's" at FIG. 3B and identified by reference number 32) at their non-tethered ends (e.g., also identified in FIG. 3B). In a similar manner, FIG.2 shows the tethered end of the secondary strap, and also may be considered to show the tethered end of the primary strap. For example, the securing mechanism may be clips, hook-and-loop fasteners, or some other mechanism for securing the fasteners 20 together. During use, the fasteners 20 may be secured to one another to provide a tension to the margin 12 (see for example, FIG. 3B). Continuing with the noted example, hook-and-loop fasteners on their loose ends may couple to cause the straps to provide tension to the margin, favorably tightening the margin 12 around the user's head. Moreover, as shown in FIG. 2 and 3B, the straps may be considered to be primary and secondary straps that each have two ends, such as a tethered end (FIG.2) and a non-tethered end (FIG.3B).

The design offered by various embodiments of the present invention provides for enhanced watertight performance of the cap, such that a user wearing the cap may become submerged in water, and even engage in vigorous activities such as swimming, while maintaining dry hair. At the same time, the cap is designed to be simple and comfortable. Caps of the prior art often are not suited to providing true waterproof functionality, especially for activities such as swimming, which involve submersion in water and vigorous motion through the water. Swim caps often are made of elastic material, such that the material of the cap must be stretched for putting the cap onto the user's head. The elastic nature of the cap causes the cap to hold fast to the user's head. However, the human head is irregularly shaped; it is not a perfect sphere. Thus, while caps made of elastic material may be watertight at the edge of the cap, at some points around the head, they very often are leaky at other points. The protrusion of the ears is one prominent source of irregularity. Another source of irregularity is the user's hair. If a user has a large amount of hair needing to be secured and kept dry by a swim cap, the mass of hair may cause stretching of the cap leading to further leakage around the edges of the cap.

Illustrative embodiments of the present invention address this problem by providing a cap made of two distinct sections, namely a shell, and a margin. The shell can be sized appropriately for accommodating a user's head, as well as a significant amount of hair. If the shell is sized large enough, the user's hair will not substantially stretch the shell. But it is the shell combined with the independent margin that makes the cap capable of forming a watertight seal around a user's head and holding the cap in place during swimming. The independent margin is thus provided to squeeze firmly against the user's head. Due to the margin's functional independence from the shell, the entry of the user's head and hair into the shell does not cause the irregular stretching of the margin that would lead to leakage.

To provide a watertight seal that will withstand being submerged in water and to hold the cap in place on the user's head during vigorous activity in water, the margin should be sufficiently wide, and should be formed from a material that is sufficiently thick. Thickness also must be chosen appropriately with concerns of cost and comfort in mind. Materials for use in contemplated embodiments include, without limitation, neoprene of thicknesses substantially between about 0.5 mm and 3 mm of thickness.

In some embodiments of the present invention, the cap is configured such that when the cap is placed on the user's head over the user's hair, the user's hair is contained within the shell, above the margin. Accordingly, the cap also may be configured to be placed on the user's head such that the margin covers the user's ears. The width of the margin defines a buffer zone between the user's hair and the water. Thus, the wider the margin, the more effectively the margin can be expected to seal water out from reaching the interior of the shell. However, the width of the margin must be limited due to other requirements. For example, the margin should not extend so far as to interfere with the user's vision. Contemplated embodiments include, without limitation, a margin width between about 1 and 2 inches.

A key element of providing a watertight seal at the margin of a swim cap is the tightness of the margin. A tighter margin is expected to provide a better seal, but if the margin is too tight, the cap will not fit on the user's head, or the cap will become uncomfortable for the user. Due to the irregular shape of the human head, especially around the ears, an elastic margin around the head will be tighter in certain locations than others.

Some embodiments of the present invention thus provide a more effective watertight seal by using one or more fasteners around the margin of the cap to selectively tighten the margin in specific areas. The fasteners may include a pair of straps, attached to and extending outward from the margin at locations corresponding to the location of the user's ears when the cap is in use. The straps may include hook-and-loop fasteners for attaching one strap to the other strap, or alternative fastening arrangements known in the art, such as buttons or buckles, may be used. When the cap is on the user's head, the straps can be pulled toward each other and attached to each other. The straps can thus provide additional pressure in support of the margin at locations where the watertight seal against the user's head is weakest, such as around the user's ears, thereby further improving the watertight nature of the cap. Additionally, use of the straps in such a fashion may have an anchoring effect, whereby the cap is held more securely in place on the user's head, and is thus less prone to shifting position, retracting upward due to the shell tension or becoming dislodged during vigorous activity in water.

When the swim cap is positioned on a user's head, the margin takes a shape according to the shape of the user's head. Thus the shape of the margin, while somewhat irregular, approximates an oval. The relative positions on the margin of the straps can be defined according to degrees along this oval. The straps are preferably coupled to the margin at first and second positions 30 corresponding to the location of the user's ears when the cap is in use (note that FIG. 2 shows one of the positions 30, while the other side of the person's face—namely, the other profile—has the other position 30). Therefore the straps will be connected to the margin at locations that are approximately 180 degrees apart along the oval of the margin. According to certain embodiments of the invention, the positions of the straps along the margin may be slightly forward or backward along the user's head, by, e.g., up to 15 degrees. Thus the first and second positions 30 may be separated by up to 195 degrees or as little as 165 degrees according to such embodiments.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A swim cap for use by a person having a skull, said person having a pair of ears, and a neck, the swim cap comprising:

a shell formed from a first substantially waterproof material, the shell forming a concave region adapted to fit over the skull of the person, the material of the shell terminating at a circumferential rim;

a resilient margin secured to the shell by a seam along the circumferential rim, the resilient margin being formed from a second substantially waterproof material, at least a portion of the resilient margin extending beyond the shell circumferential rim in a direction away from the concave region, wherein the margin is adapted to apply adhering pressure to the person's skull;

a primary strap, formed from a third material, having a tethered end and a non-tethered end, the primary strap being coupled to the resilient margin at the tethered end of the primary strap, such that the primary strap lays on top of and parallel to and along the margin, with the non-tethered end of the primary strap extending toward a rear portion of the cap, the rear portion of the cap being designed to conform to the back of a neck of the person;

a primary securing mechanism coupled to the primary strap at the non-tethered end of the primary strap;

a secondary strap, formed from a fourth material, having a tethered end and a non-tethered end, the secondary strap being coupled to the resilient margin at the tethered end of the secondary strap, such that the secondary strap lays on top of and parallel to and along the margin, with the non-tethered end of the secondary strap extending toward the rear portion of the cap; and a secondary securing mechanism, coupled to the secondary strap at the non-tethered end of the secondary strap;

wherein the primary strap is tethered to the margin in a first position wherein the first position is adapted to be disposed on the resilient margin within a first range of locations beginning at or about a person's ear and ending slightly behind the ears;

wherein the secondary strap is tethered to the margin in a second position wherein the second position is adapted to be disposed on the resilient margin within a second range of locations beginning at or about a person's other ear and ending slightly behind the ears;

wherein the first position and the second position are separated by between 165 and 195 degrees as measured along the margin, and wherein the primary and secondary securing mechanisms are configured to fasten to each other on top of and parallel to and along the margin, thereby being adapted to selectively tighten a portion of the margin underneath the straps against a user's head, and wherein the primary and secondary straps are adapted to each press on the portions of the margin underneath the respective strap, thereby being adapted to close gaps between the portions of the margin underneath the straps and the user's head;

and wherein the primary and secondary straps are adapted to provide pressure at the ears so as to achieve a watertight seal.

2. A swim cap according to claim 1 wherein the first and second materials are the same material.

3. A swim cap according to claim 1 wherein the first and second materials are different materials.

4. A swim cap according to claim 1 wherein at least one of the first and second materials comprises neoprene.

5. A swim cap according to claim 4 wherein the neoprene has a thickness between about 0.5 millimeters and about 3 millimeters.

6. A swim cap according to claim l wherein the margin has a width of between about 1 inch and about 2 inches.

7. A swim cap according to claim 1 wherein the primary securing mechanism and the secondary securing mechanism are hook-and-loop fasteners.

8. The swim cap as defined by claim 1 wherein the primary strap and the secondary strap each has a width that is equal to or less than a width of the margin.

* * * * *